US005883341A

United States Patent [19]

Terriss et al.

[11] Patent Number: 5,883,341

[45] Date of Patent: Mar. 16, 1999

[54] MESSAGE CUBE

[76] Inventors: Howard L. Terriss, 20 Cedar St., New Rochelle, N.Y. 10801-5217; Marc Chase Weinstein, 30 E. 95th St., New York, N.Y. 10128

[21] Appl. No.: 826,255

[22] Filed: Mar. 27, 1997

[51] Int. Cl.[6] ..... G09F 27/00

[52] U.S. Cl. ..... 181/141; 40/455; 40/717

[58] Field of Search ..... 181/141, 199, 181/160; 40/455, 717, 906

[56] References Cited

U.S. PATENT DOCUMENTS

| | | | |
|---|---|---|---|
| 3,696,855 | 10/1972 | Grieg et al. | 181/199 |
| 3,743,370 | 7/1973 | Lindsay et al. | 40/455 |
| 4,541,188 | 9/1985 | Sadorus . | |
| 5,533,290 | 7/1996 | Lee et al. | 40/455 |

OTHER PUBLICATIONS

"Acoustics," Microsoft (R) Encarta. Copyright (c) 1993 Microsoft Corporation. Copyright (c) 1993 Funk & Wagnall's Corporation.

*Primary Examiner*—Khanh Dang
*Attorney, Agent, or Firm*—Myron Amer P.C.

[57] ABSTRACT

An article of manufacture having voice-recording and recorded voice-playback mechanisms having a cube external shape, which is disguised as a household decorative fixture, e.g. a photograph holder, and internally bounding an echo chamber, e.g. a volume of at least 60 cubic inches, such that there is sufficient clarity in the played back recording due to the use of the echo chamber to enable recognition of the voice, to thereby add to the gift value of the article of manufacture.

1 Claim, 1 Drawing Sheet

FIG.1
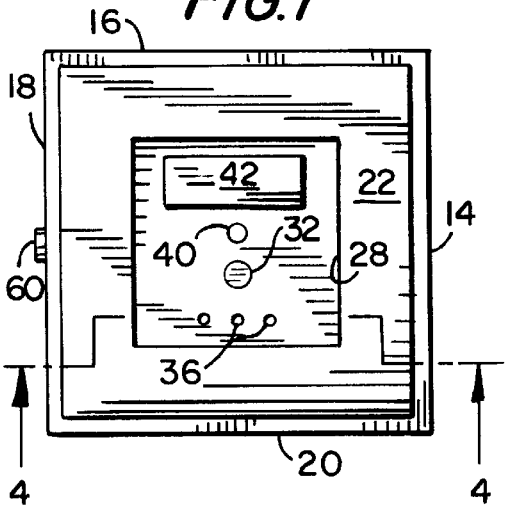
FIG.2
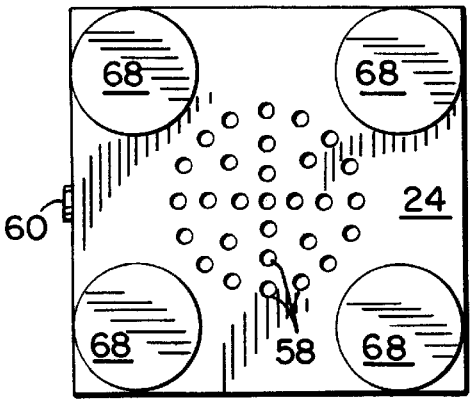
FIG.3
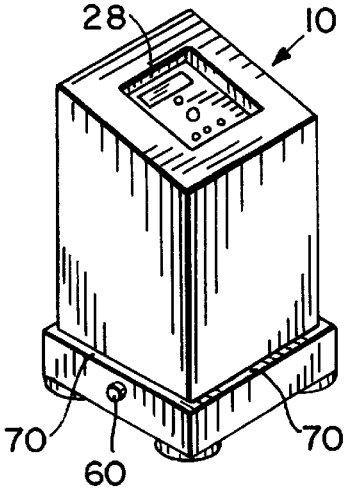
FIG.4
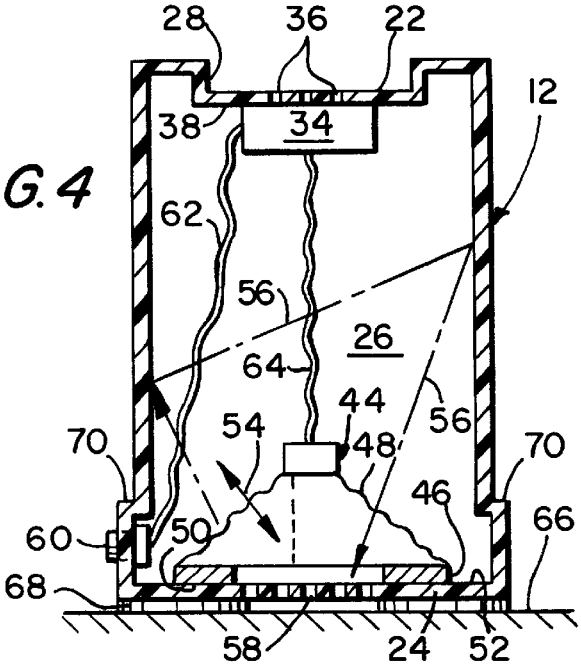
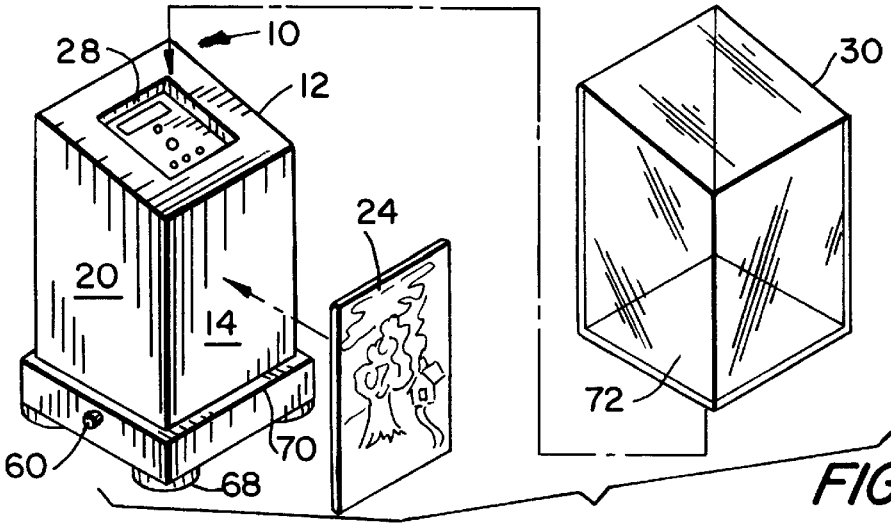
FIG.5

MESSAGE CUBE

The present invention relates generally to improvements to articles of manufacture employing voice-recording and recorded voice-playback mechanisms, the improvements more particularly embodying the mechanism in a construction significantly enhancing the clarity of the recorded voice playback.

EXAMPLE OF THE PRIOR ART

It is already known in the patented literature, as exemplified by U.S. Pat. No. 4,541,188 issued to George P. Sadorus for "Reflective Audio Assembly and Picture" on Sep. 17, 1985, that the gift value of a photograph article of manufacture can be significantly enhanced by known voice-recording and recorded voice-playback means, wherein what is recorded and played back is in the voice of the individual in the photograph. To achieve the purposes intended, namely to correlate the played-back voice with a specific individual, the voice recording played back must have a degree of clarity that provides voice recognition, i.e. it must sound like the voice of the photographed individual.

In the Sadorus and all other known patented embodiments using known voice recording and recorded-voice playback means, the recorded voice that is played back is of minimal clarity, even though, as in Sadorus, use is made of a sound enclosure 30 to improve sound clarity. Sound clarity, however, as applied for example to an auditorium, requires so-called reverberation time wherein a sound is audible for a second or even less in the auditorium even after the sound has stopped in the auditorium, a phenomenon which is typically achieved by the construction or architecture of the auditorium. The sound enclosure 30 of Sadorus, which is exemplary of prior art efforts, is only of nominal effectiveness in contributing to sound clarity and consequently in providing voice recognition in the recorded voice playback.

Broadly, it is an object of the present invention to provide a voice-recording and recorded-voice playback article of manufacture overcoming the foregoing and other shortcomings of the prior art.

More particularly, sound clarity is provided in accordance with the present invention in an external housing suited to this purpose, but which housing unavoidably in shape and size is not optimally suited to contribute to a gift presentation or appearance for the article of manufacture, this latter noted shortcoming, however, is obviated by disguising the housing as a decorative household fixture, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a plan view of the within inventive message recording and playback device;

FIG. 2 is a bottom view thereof;

FIG. 3 is a perspective view thereof;

FIG. 4 is a front elevational view, in section, taken along lines 4—4 of FIG. 1; and FIG. 5 is another perspective view with a cooperating cover.

With known voice-recording and recorded voice-playback means, as described in prior patented literature as exemplified by U.S. Pat. No. 4,541,188 issued to George P. Sadorus for "Reflective Audio Assembly and Picture" on Sep. 17, 1985, advantageous use is made, in accordance with the present invention, of echo chamber technology to significantly enhance the clarity in the played back recorded voice, the clarity being to the extent that the voice is readily recognized by the user contributing to the gift value of the within inventive message recording and playback device, generally designated 10.

To this end, device 10 has a cube-shaped body 12, preferably of plastic construction material, formed of spaced apart four opposite side walls 14, 16, 18 and 20, each 3.5×3.5×5 inches, a top wall 22, and a bottom wall 24 which cooperate to bound an internal echo chamber 26, the latter it is to be understood is a structure which, by analogy to auditorium walls, reflects most of the sound that strikes them, diminished typically with each reverberation or reflection one-millionth of its original intensity, or so-called reverberation time, so that the sound is audible for one to two seconds after the sound has stopped in an auditorium or, in this case, in the echo chamber 26. In practice, good results have been achieved using an echo chamber 26 having a volume of 62 cubic inches.

In the clearance of a recess 28 in the top wall 22, so as not to be inadvertently actuated by placement over the body 12 of a cover 30, soon to be described, is a depressible button 32 which in a known manner initiates the operation of voice-recording means 34 attached, as by adhesive or other appropriate means, beneath an array of speak-into openings, individually and collectively designated 36, in the echo chamber 26 and to the interior surface 38 of the top wall 22, the operation of the voice-recording means 34 being made known to the user by the illumination of a LED 40, and in a preferred embodiment providing a voice-recording interval of approximately ten seconds. A pivotal cover 42 provides access to a battery compartment.

Also positioned in the echo chamber 26 is the known recorded voice-playback means, generally designated 44, consisting of a rigid rim 46 in encircling relation about a vibrating speaker means 48, only the rim 46 being attached, as by adhesive or other appropriate means, as at 50, to the interior surface 52 of the bottom wall 24, and the vibrating means 48 being in a clearance position from the bottom wall surface 52 and any other wall surface bounding the echo chamber 26, which, in the sound produced by the recorded voice-playback means 44 has a clarity resulting from unimpeded vibration 54 of the vibrating speaker means 48 and also an amplification of reverberation, as noted by the arrows 56, off of the walls bounding the echo chamber 26, said emitted sound being transmitted through an array of hear-through openings, individually and collectively designated 58, located in the bottom wall 24 beneath the vibrating speaker means 48. Playback is initiated by depressing a depressible button 60 having an electrical connection 62 to the voice-recording means 34 which, in turn, has an electrical connection 64 to the recorded voice-playback means 44. To obviate muffling of the recorded voice playback, the cube 12 is held in a clearance position above a support surface 66 on corner spacers 68.

To contribute to the value of the device 10 as a gift article of manufacture, shoulders 70 are provided on the exterior of the walls 14, 16, 18 and 20, to support the previous noted cover 30 having a bottom opening 72, and of clear plastic construction material and slightly oversized and similarly cube-shaped to fit with a slight fitting clearance over the cube body 12. Photographs, as exemplified by the photograph 74, are adapted to be positioned in the fitting clearance upon a supporting shoulder 70 and would typically be sent to a gift recipient with an appropriate ten second voice message such as "Hi Mom and Dad, this is your new grandson! Listen to his great voice . . . sound familiar?" The recipient has the option of recording a household chore message or the like over the initial recorded message, and the photographs 74 effectively disguise the device 10 as a decorative household fixture.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a combination message recording and playback device and photograph holder of a type having known voice-recording means and recorded voice-playback means positioned internally of said device and photographs displayed externally thereof, said improvements embodied in said combination message recording and playback device and photograph holder comprising a cube-shaped body of plastic construction material formed of spaced apart four opposite side walls, a top wall and a bottom wall bounding an echo chamber of not less than 60 cubic inches, means attaching said voice-recording means in said echo chamber to an interior surface of said top wall, means attaching said recorded voice-playback means in said echo chamber to an interior surface of said bottom wall, said recorded voice-playback means consisting of a rigid circular rim in encircling relation about a vibrating speaker means having only said circular rim in attached relation to said bottom wall interior surface and said vibrating speaker means in a clearance position therefrom and from any said walls bounding said echo chamber, each said side wall having an external surface of a selected rectangular shape and size, and a cooperating photograph for each said side wall of a similar selected rectangular shape and size as said side wall, said photograph having an operative position in attached relation to said side wall external surface so as to contribute to providing said cube-shaped body with a disguise as a household photograph holder and whereby said sound produced by said recorded voice-playback means has a clarity of an unimpeded vibration of said vibrating speaker means and an amplification of reverberation off of said walls bounding said echo chamber.

* * * * *